United States Patent [19]

Urban et al.

[11] Patent Number: 5,069,438

[45] Date of Patent: Dec. 3, 1991

[54] PAPER TRAY SUPPORT AND PAPER FEED FOR REPRODUCTION APPARATUS

[75] Inventors: Carl T. Urban, Troy; James B. Gahan, Spencerport, both of N.Y.

[73] Assignee: Eastman Kodak Company, Rochester, N.Y.

[21] Appl. No.: 604,266

[22] Filed: Oct. 29, 1990

[51] Int. Cl.[5] ..... B65H 5/00

[52] U.S. Cl. ..... 271/10; 271/116; 271/119; 271/145; 271/153; 271/265; 192/84 T; 384/125

[58] Field of Search ..... 271/9, 10, 109, 110, 271/114, 116, 119, 145, 153, 265; 192/336, 84 T; 384/125

[56] References Cited

U.S. PATENT DOCUMENTS 4,529,188 7/1985 Sturnik ..... 271/10
4,790,524 12/1988 Murakami et al. ..... 271/9 X

FOREIGN PATENT DOCUMENTS 0078021 5/1984 Japan ..... 271/10
0089732 3/1990 Japan ..... 271/9

*Primary Examiner*—H. Grant Skaggs
*Assistant Examiner*—Carol Lynn Drazbick
*Attorney, Agent, or Firm*—Lawrence P. Kessler

[57] ABSTRACT

A paper cassette support and associated paper feed for reproduction apparatus are assembled as a module. The paper cassette support is made of a resinous material which includes carbon fibers to minimize the deposit of electrostatic charge and self-lubricating material for providing bearings which are molded unitarily with the side panels. The side panels, when assembled, define a cassette support section and a paper transport section, the cassette support section having shelves and cassette retaining springs molded therein. Paper transport slots are molded into step portions of the side panels, as are bearings and spring retainers for shafts and spindles supporting pairs of rollers. An associated feed drive includes output shafts for rotating D-rollers that frictionally advance paper one sheet at a time from paper stacks in cassettes received in the paper cassette support section. Each feed drive includes a magnetic clutch which is selectively activated by a power supply and limits the D-rollers to one rotation. This accomplished by a cam wheel which is rotated upon engagement of the magnetic clutch and assumes control of the power supply after rotation of the output shaft is initiated. The cam wheel interrupts power to the magnetic clutch upon completion of one revolution, stopping rotation of the activated output shaft.

21 Claims, 11 Drawing Sheets

PAPER TRAY SUPPORT AND PAPER FEED FOR REPRODUCTION APPARATUS

BACKGROUND OF THE INVENTION

The instant invention is directed to a paper tray support and paper feed for reproduction apparatus and the like. More particularly, the instant invention is directed to a paper tray support and paper feed, wherein the number of components is minimized and wherein the sheet feeding mechanism is simplified and made less expensive.

The cost of manufacturing and maintaining reproduction apparatus continues to increase even though the associated technology is now well developed and competition assured by numerous manufacturers. Numerous improvements have, of course, been improvements have added to the complexity of such apparatus, further escalating costs in manufacture and maintenance.

One component of desktop reproduction apparatus which is a high-cost item is the paper tray support used with multiple copy machines. Paper tray supports generally consist of a multiplicity of small mechanical parts such as bearing surfaces, retainers, springs, and the like. Accordingly, assembling paper tray supports is a labor-intensive, tedious, timeconsuming operation which is expensive in and of itself and in which mistakes can be easily made.

Since considerable hand assembly is required, it is difficult for manufacturers to subcontract out assembly with the assurance that quality control will be maintained. However, in order to control overhead and costs, it is frequently desirable for manufacturers to subcontract assembly whenever possible. This is especially the case with relatively low cost, high volume desktop reproduction apparatus in which relatively small decreases in manufacturing costs can translate into significant increases in sales as long as quality is maintained.

In reproduction apparatus, a paper feed mechanism usually functions in conjunction with the paper tray support. It is therefore desirable to have paper feed mechanisms which are reliable, inexpensive to manufacture and preferably integral with the paper tray support. It is advantageous to have paper feed mechanisms integral with paper tray supports in that during manufacture, such an arrangement can simplify assembly. Moreover, maintenance may be simplified in that an entire module may be quickly removed for repair and replaced with a spare or new module relatively quickly. This reduces downtime of the reproduction apparatus and allows the actual repair to take place at a maintenance shop.

In view of the aforedescribed and other considerations, there is a need for improvement in the configuration of paper tray supports and associated paper feeds utilized in reproduction apparatus. This is especially the case for low-cost desktop reproduction apparatus.

SUMMARY OF THE INVENTION

In view of the aforedescribed considerations, it is an object of the instant invention to provide a new and useful paper tray support module which is relatively inexpensive to manufacture, service, maintain, and replace and wherein the paper tray support is modular in configuration and includes therewith a new and improved paper feed drive which has minimal manufacturing costs, simplified construction, and high reliability.

It is a further object of the invention to provide a new and improved mechanism for a paper feed drive.

In view of the aforedescribed and other objects, the instant invention contemplates a modular paper tray support, useful in reproduction apparatus, which includes first and second side panels configured for assembly in opposed relation to define a space therebetween. The assembly has a paper tray support section and a paper transport section. The paper tray support section includes shelves unitary with the side panels and extending into the space for supporting at least one paper tray, while the paper transport section has stepped portions unitary with the side panels and extending into the space in juxtaposition with the paper tray section. Each step portion has at least one slot molded therein for the passage of paper sheets removed from the paper tray and includes spindle retainers and shaft bearings unitary with and molded within the step portions adjacent the slots. An array of rollers, paired in opposed relation, are mounted by spindles supported by the spindle retainers and by shafts journaled in the shaft bearings. A drive mechanism is mounted on one of the side panels for rotating the shafts.

In accordance with one embodiment of the invention, the side panels are made of a resinous material having conducting fibers distributed therein to minimize accumulation of electrostatic charge, as well as a self-lubricating material for forming bearing surfaces for the shafts. In accordance with a further embodiment of the invention, the side panels include latching elements and juxtaposed stop members so that the side panels, in effect, can be snapped together during assembly.

The instant invention further contemplates a drive mechanism useful for rotating paper feed rollers one revolution at a time, which drive mechanism in conjunction with the modular paper tray support provides a reliable paper feed system at minimal cost.

The drive system contemplated by the instant invention includes an output shaft upon which an input hub and output hub are coaxially mounted. The output hub is mechanically coupled to the output shaft, while the input hub is normally freely rotatable upon the shaft. A coil of an electromagnet is juxtaposed with the input and output hubs for magnetically coupling the hubs upon being energized. A cam having an indicator at one circumferential location thereon for indicating one revolution of the cam is fixed to the output shaft, and a cam follower for detecting the presence or absence of the indicator engages the cam. A power supply is connected to the magnetic clutch through a logic and control switch which, when closed, energizes the coil coupling the input hub to the shaft and cam, causing the shaft and cam to rotate. The cam activated switch, which is normally open when registered with the indicator on the cam, closes upon rotation of the cam to open the logic and control switch to keep the power supply connected to the coil so that the output shaft and cam continue to rotate until the follower again registers with the indicator means on the cam. Upon the follower registering the indicator, the cam switch opens, interrupting power to the coil and stopping rotation of the output shaft. In accordance with a more specific embodiment of the invention, the output shaft is used to rotate D-rollers in a reproduction apparatus in order to advance sheets of paper one at a time from the top of a stack of paper in such apparatus.

In accordance with a further embodiment of the invention of interest with respect to paper feed trays of reproduction apparatus, a pair of drive mechanisms are positioned adjacent one another on the reproduction apparatus with their input hubs mechanically connected together whereby the continuous input rotates the input hubs simultaneously with paper feed occurring only with the drive mechanism having the coil of its magnetic clutch energized.

BRIEF DESCRIPTION OF THE DRAWINGS

Various other objects, features, and attendant advantages of the present invention will be more fully appreciated as the same becomes better understood when considered in conjunction with the accompanying drawings, in which like reference characters designate the same or similar parts throughout the several views and wherein.

DETAILED DESCRIPTION

Figure 1:
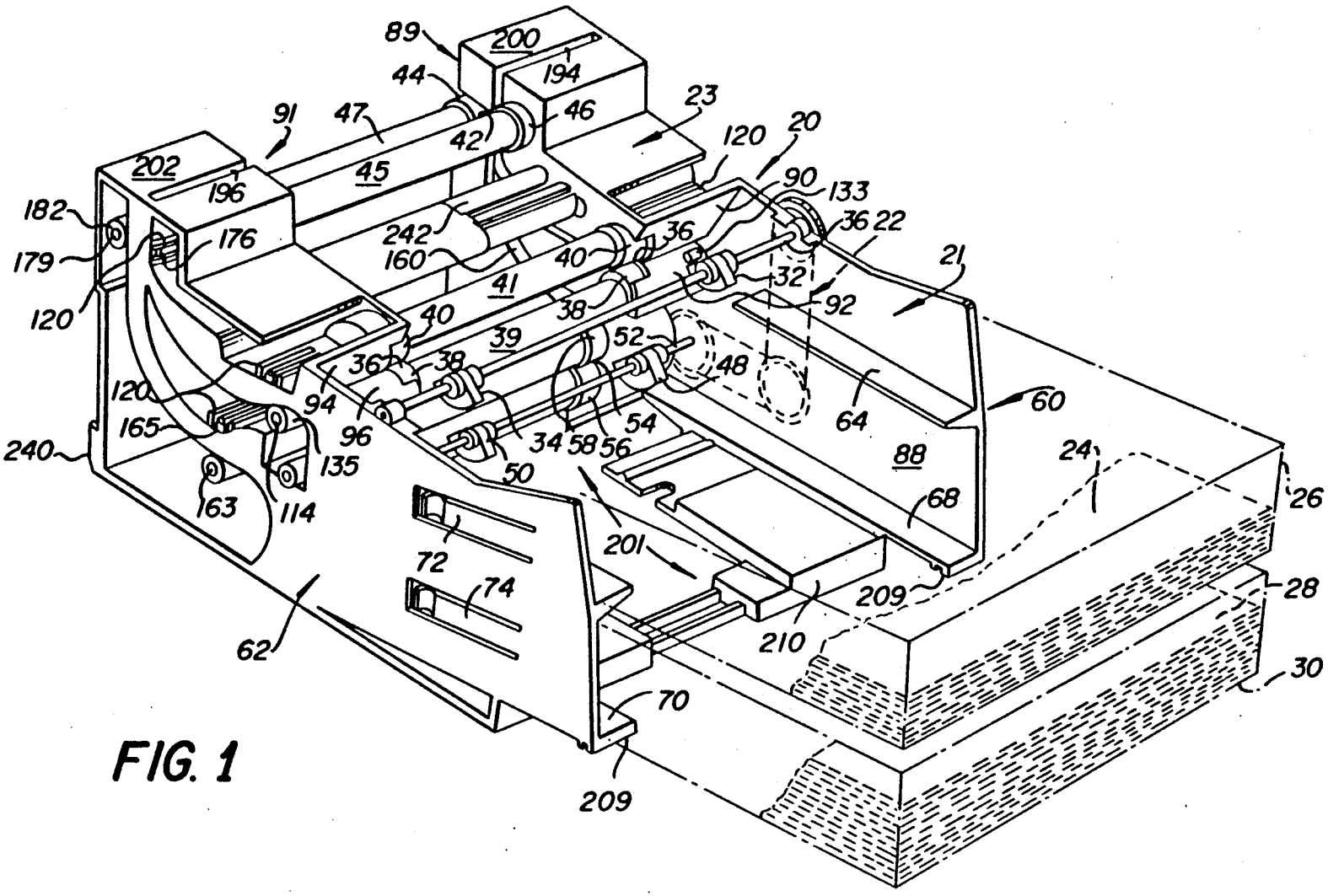
FIG. 1 is a perspective view of a paper tray support configured in accordance with the instant invention.

A. General Description of the Paper Tray Support Module and Paper Feed Mechanism Referring now mainly to FIG. 1, there is shown a paper tray support, designated generally by the numeral 20, which is configured for use, for example, with a desktop reproduction apparatus (not shown). Paper tray support 20 is a modular unit having a paper tray support section, designated generally by the numeral 21, which includes integral lines and designated generally by the numeral 22. The paper feed mechanism 22 feeds sheets of paper one at a time to a paper transport section, designated generally by the numeral 23, from either a first stack of paper 24 in a first paper cassette 26 or a second stack of paper 28 in a second cassette 30. In accordance with conventional practice, the paper in stack 24 may have the same or different dimensions than the paper in stack 28.

Considering the operation generally, paper in the top paper tray 26 is withdrawn one sheet at a time by D-rollers 32 and 34 fixed to a shaft 36 rotated by the paper feed mechanism 22. Rotation of the shaft 36 causes D-rollers 32 and 34 to frictionally engage the top sheet of paper in the stack 24 and displaces the sheet to insert its leading edge in nips 36 between the pairs of rollers 38 and 40 separated by spacers 39 and 41, respectively. Rollers 38 and 40 rotate continuously to pull the top sheet from the stack 24 and eventually propel the sheet through a nip 42 between final feed rollers 44 and 46, separated by spacers 45 and 47, respectively. The final feed rollers 44 and 46 eject the sheet from the support module 20 into the reproduction apparatus (not shown) where an image of original information is reproduced on the sheet.

If it is desired to copy on paper from the lower stack 28 in lower tray 30, D-rollers 48 and 50 fixed shaft 52 are rotated by the sheet feeding mechanism 22 to frictionally engage and propel the top sheet of the stack into a nip 54 between lower rollers 56 and 58 which pull the single sheet and convey the single sheet to the nip 42 between rollers 44 and 46 to propel the sheet to the reproduction apparatus (not shown) for reproducing an image of original information on the sheet.

While the general operation discussed thus far is conventional, it is performed in a paper tray support module 20 of a unique construction and by a paper feed mechanism 22 of a unique configuration and operation.

B. The Structure of the Paper Tray Support Module 20

Figure 2:
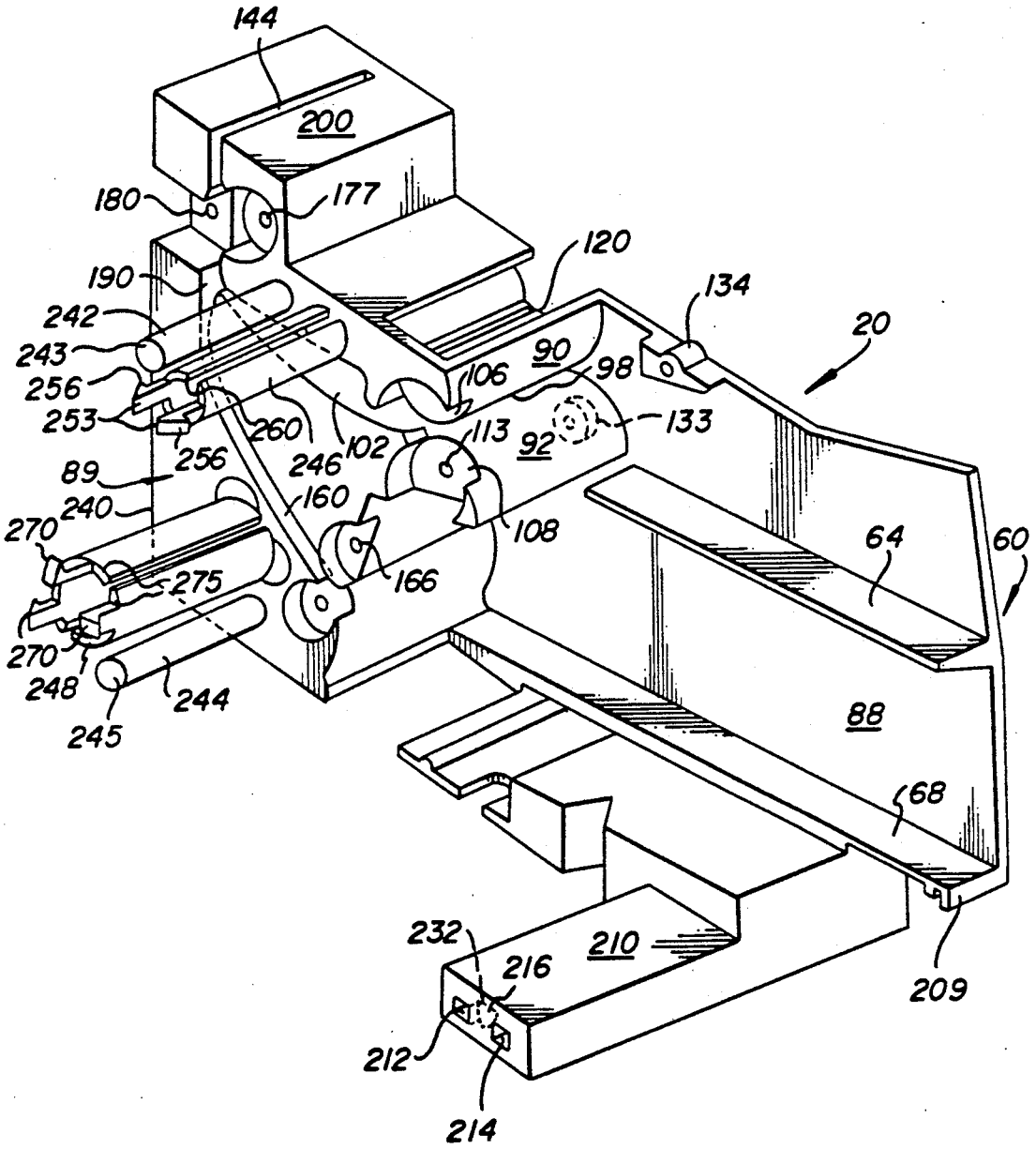
FIG. 2 is a perspective view of a first side panel of the paper tray support of FIG. 1.
Figure 3:
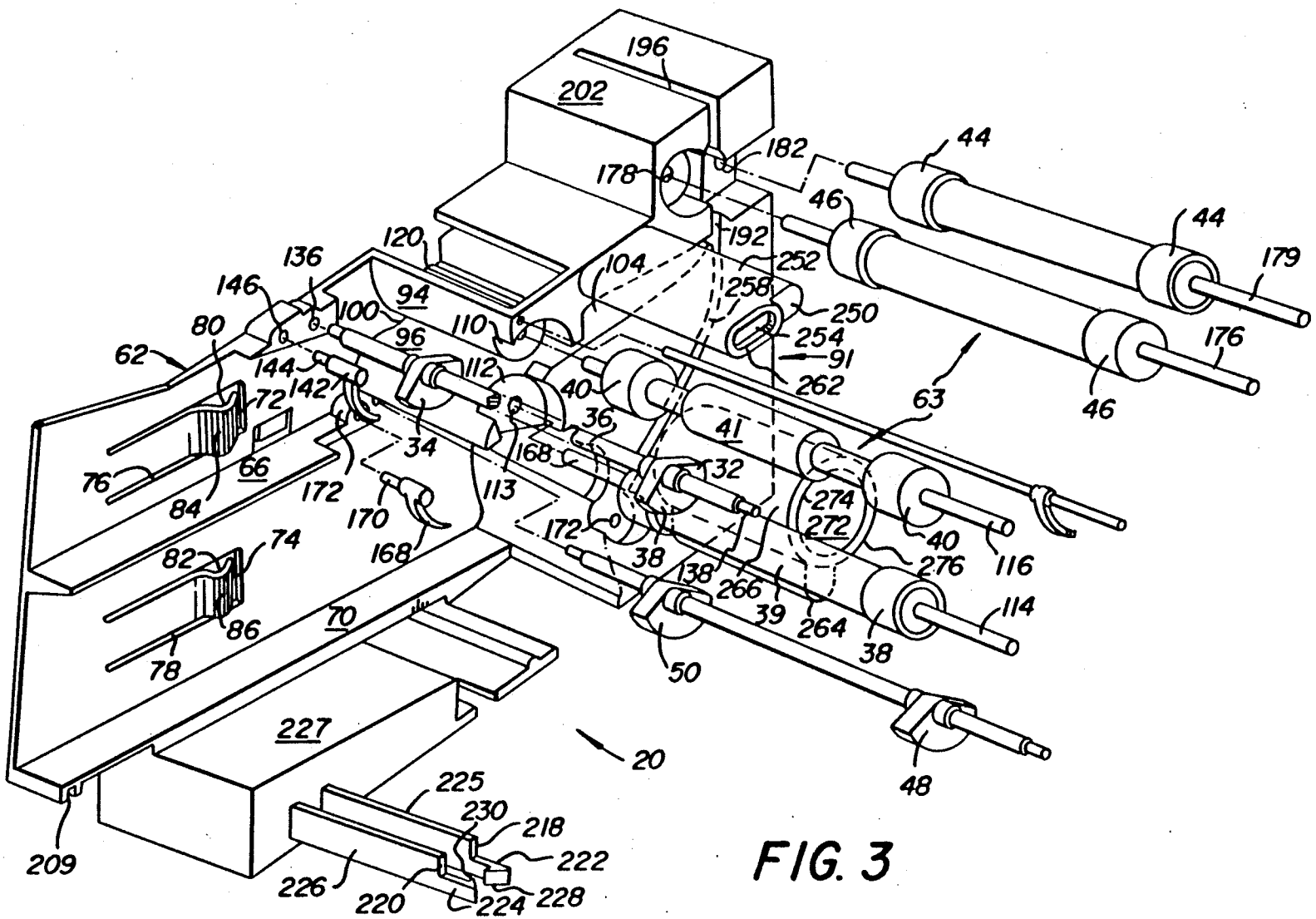
FIG. 3 is an exploded view, in perspective, of a second side panel of the paper tray support of FIG. 1 with various rotatable components aligned for retention thereby.

Referring now mainly to FIGS. 2 and 3 in conjunction with FIG. 1, it is seen that the module 20 has a first sidewall, designated generally by the numeral 60 (FIG. 2), and a second sidewall, designated generally by the numeral 62 (FIG. 3). The sidewalls 60 and 62 are each molded of a resilient, dielectric, resinous material such as polycarbonate which is filled with carbon fiber to minimize accumulation of electrostatic charge and may also include a self-lubricating additive to provide bearing surfaces where needed. The carbon fibers (and self-lubricating additive) are distributed throughout the material molded to form side panels 60 and 62 and allow structures, which in prior art paper tray supports are separate components, to be unitary with the side panels. A self-lubricating material such as, for example, is included in the resin is supplied in a range of from 8–20% and preferably about 12% by weight. An array of some of the rotatable components, designated generally by the numeral 63, is shown in FIG. 3 for mounting between the side panels 60 and 62 when the side panels are assembled as in FIG. 1.

The side panels 60 and 62 have upper shelves 64 (FIG. 2) and 66 (FIG. 3), respectively, for supporting the upper paper cassette 26 (FIG. 1) and the lower paper cassette 30 (FIG. 1). In order to retain the upper paper cassette 26 in place, a cantilevered leaf spring 72 is formed in the side of the second panel 62 above shelf 66 and in order to retain the lower paper cassette 30 in place, a cantilevered leaf spring 74 is positioned above the lower shelf 70. The cantilevered springs 72 and 74 are molded in recesses 76 and 78, respectively, with the material forming bowed ends 80 and 82, which bowed ends, in effect, provide cam surfaces 84 and 86 to deflect the springs 72 and 74 when the cassettes 26 and 30 (FIG. 1) are inserted. Bowed ends 80 and 82 urge their respective cassettes 26 and 30 toward a smooth inner surface 88 of the first side panel 60. In this manner the cassettes are accurately positioned between the side panels 60 and 62 in the module 20.

Disposed on step portions, designated generally by the numerals 89 and 91, in front of the upper shelves 64 and 66 are pairs of opposed curved ramps 90, 92 and 94, 96, respectively. Between the curved ramps 90, 92 and 94, 96 are openings 98 and 100, respectively, for paper-receiving slots 102 and 104, respectively. Each of the ramps 90, 92 and 94, 96 has cutouts 106, 108 and 110, 112, respectively, which receive the ends of rollers 38 and 40, respectively. The cutouts 106-112 each have a circular hole 113, which hole receives one end of a shaft 114 or spindle 116 which mount rollers 38 and 40, respectively.

Figure 4:
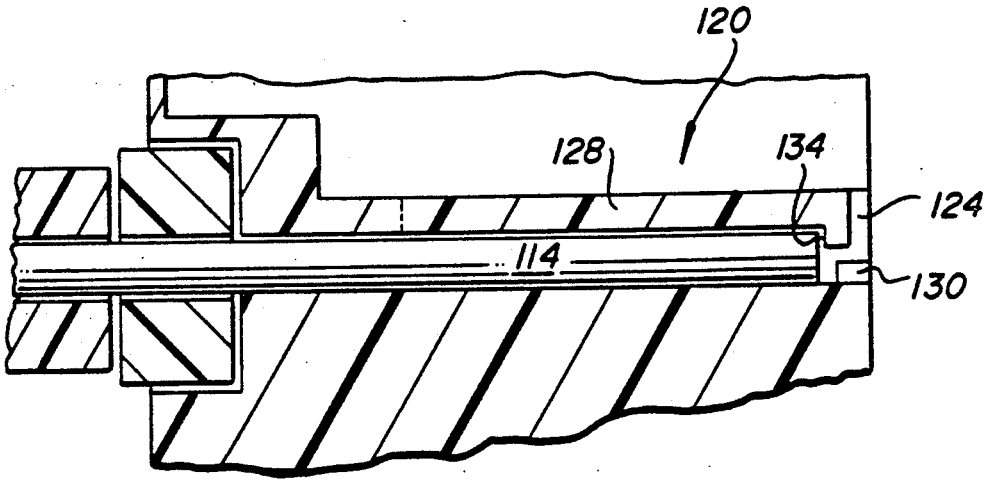
FIG. 4 is a side view of a spring stop used for retaining shafts of the assembly of FIGS. 1–3.
Figure 5:
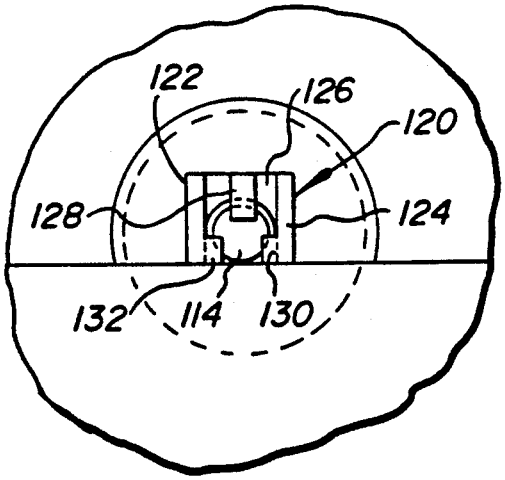
FIG. 5 is an end view of the spring stop of FIG. 4.

Within cavities behind each of the ramps 90 and 94 are spring-biased retaining stops designated generally by the numeral 120. As is seen in FIGS. 4 and 5, each of the spring stops 120 is substantially the same and comprises sidewalls 122 and 124, which define a slot 126 therebetween in which cantilevered spring arm 128 is disposed. The walls 122 and 124 have shoulders 130 and 132, respectively, while the spring arm 128 has a shoulder 134. The shoulders 130, 132, and 134 cooperate to form a stop for the end of whichever shaft or spindle (such as the spindle 116) is received therein. The spring arm 128 exerts a bias to lightly clamp the retained spindle 116 during assembly of the side panels 60 and 62, one with the other. It is not necessary for spindle 116 to be restrained from rotation since the rollers 40 are journaled on the spindle to rotate with respect thereto.

The shaft 114 mounts the driving rollers 38, which are fixed thereto on opposite sides of the spacer 39 and bear against idler rollers 40 on shaft 114. The shaft 114 projects completely through the cavities behind ramps 92, 96 and is journaled in bearings 133 and 135, which are unitary with side panels 60 and 62, respectively. Since the resin of which the side panels 60 and 62 are made may be filled with a lubricating additive, the shaft 114 rotates freely as it is driven by the paper feed mechanism 22 (see FIGS. 10 and 11).

The shaft 36 mounting the D-rollers 32 and 34 has its ends journaled in bearings 134 and 136 on the panels 60 and 62, respectively, so as to rotate freely with respect thereto. One end 138 of the spindle 36 passes completely through the first side panel 60 and is positively connected to the paper feed drive mechanism 22.

Juxtaposed with the spindle 36 is a sensor arm 142 mounted on a circular shaft 144 which projects through a bearing surface 146 molded in the second panel 62. The circular shaft 144 supports an arm 148 having a magnet 150 mounted thereon (see FIGS. 6 and 9). The magnet 150 sweeps over a magnetic switch 152, which is connected via lines 154 to the logic circuitry (not shown) of the reproduction apparatus (not shown). The arm 142 rests on top of the stack of paper 24 in the tray 26 (FIG. 1). When substantially all of the paper has been removed from the stack 24, the arm 42 drops low enough so that the magnet 150 moves into proximity with the switch 152, thereby signaling the logic and control circuitry of the reproduction apparatus (not shown) that paper is low, or that paper is substantially exhausted, so that the reproduction apparatus will respond appropriately. As with other bearings in the side panels 60 and 62, the bearing 146 molded into the second side panel 62 allows free rotation of the shaft 144 due to the self-lubricating properties of the material of which the side panel is made.

Figure 10:
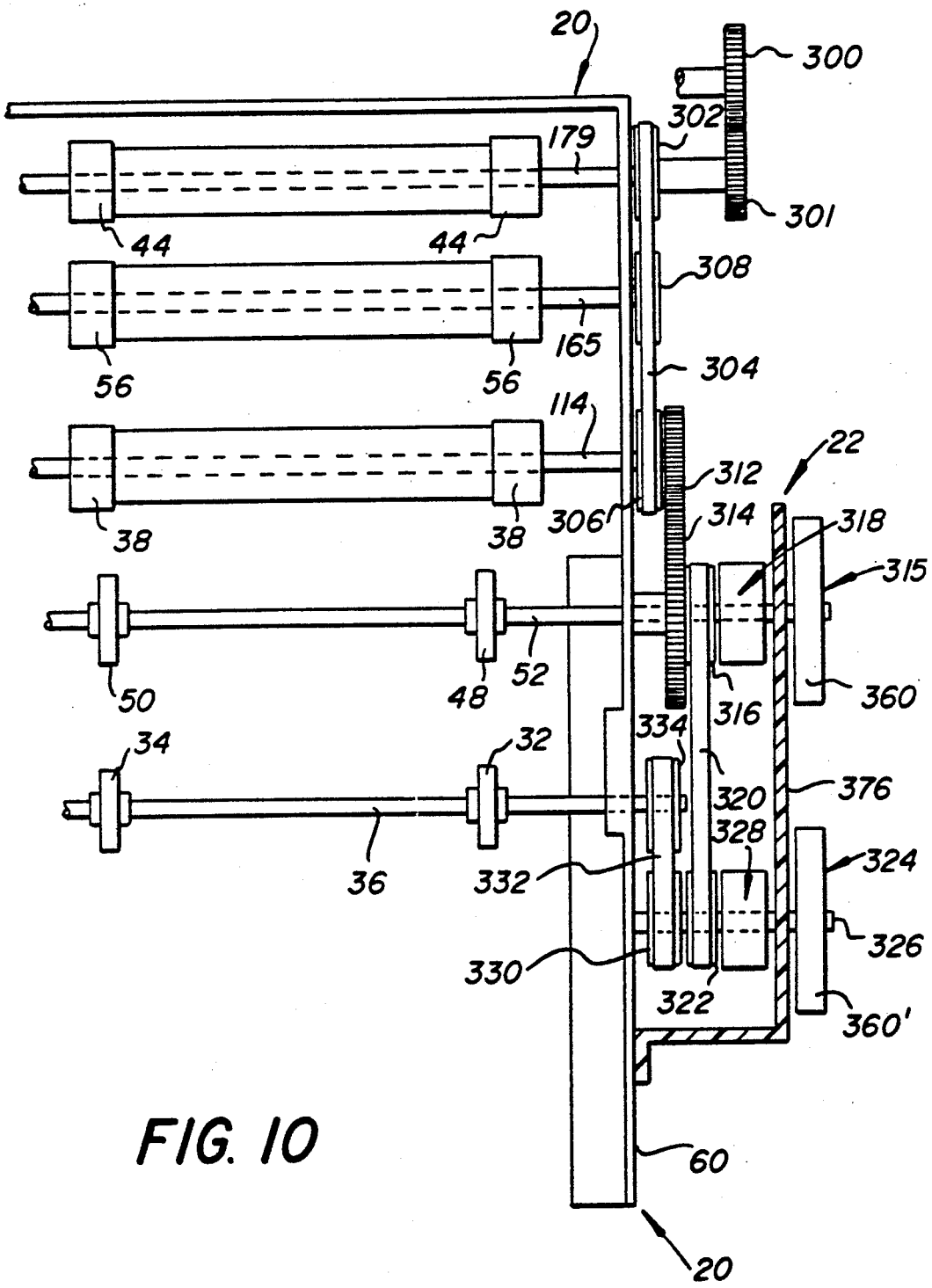
FIG. 10 is a top view of the paper tray support showing the drive mechanism and various rotatable components drive thereby.
Figure 11:
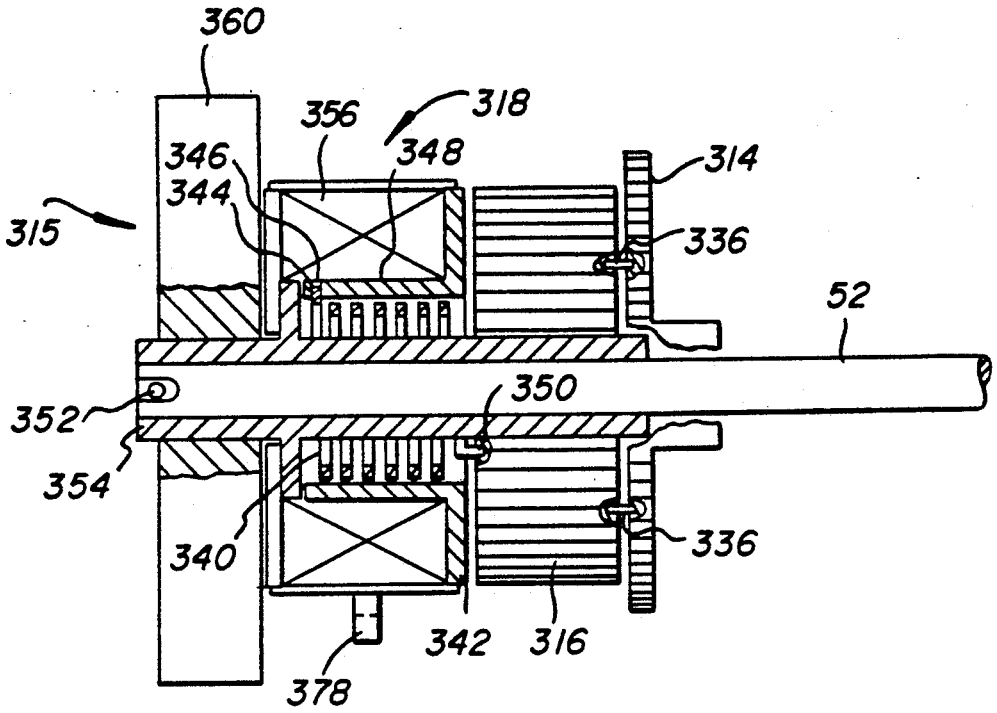
FIG. 11 is a side elevation of a first magnetic clutch mechanism used to rotate D-rollers for displacing single sheets of paper from a stack of paper in a first tray.

Continuing to refer mainly to FIGS. 1, 2, and 3, the lower stack of paper 28 in paper tray 30 provides single sheets of paper taken therefrom by rotation of D-rollers 48 and 50. The D-rollers 48 and 50 convey the single sheets of paper into slots 160 and 162 by drawing the single sheets through the nip 54 between rollers 56 and 58 (both omitted from FIG. 3 for clarity but shown in FIGS. 1 and 6) which are mounted in the same fashion as previously discussed rollers 38 and 40, wherein the bottom rollers 56 are positively driven by drive mechanism 22 through shaft 163 while top rollers 58 rotated freely on spindle 165. The spindle 165 for the rollers 56 passes through circular opening 166 in the step portion 89 of side panel 60 (FIG. 1) and the opening 167 in the step portion 91 of side panel 62 (FIG. 2) for retention by a spring retainer similar to the spring retainer 120 of FIGS. 4 and 5, as described previously. The shaft 163 to which the lower rollers 56 are fixed is journaled through bearing 168 in the step portion 89 of side panel 60 and bearing 169 in step portion 91 of the side panel 62. An end 167 of the shaft 165 is fixed to a drive sprocket in the paper feed mechanism 22 (FIGS. 10 and 11).

The quantity of paper in the stack 28 of the lower paper tray 30 is monitored by a pivoted detector arm 171 (FIG. 3) which is in turn journaled in a bearing 172 molded into side panel 62. An arm 173 (see FIGS. 6 and 9) mounting a magnet 174 drops into proximity with a magnetic detector 175 mounted on the other side of side panel 62 to indicate low paper in the stack 28 (FIG. 1).

The final feed rollers 44 and 46 are mounted in the same fashion as the selective feed rollers 38–40 and 56–58, with the idler roller 46 having its spindle !76 inserted through a round opening 177 in the step portion 89 of side panel 60, and through circular opening 178 in the step portion 91 of side panel 62. As with the spindles !16 and !65, retainers 120 of FIGS. 4 and 5 are positioned behind the openings 177 and 178 and within the step portions 89 and 91 to retain the non-rotating spindle 176 in place. The rotating shaft 179 with the roller 44 fixed thereto is journaled in bearings 180 and 182 in the hollow step portions 89 and 91 of side panels 60 and 62, respectively.

As is best seen in FIGS. 2 and 3, the slots 102 and 160 of the side panel 60 and the slots 104 and 162 in the side panel 62 merge into slot 190 and 192, respectively, just upstream of the rollers 44 and 46 so that single sheets of paper passing through slots 104–102 and 160–162 are ejected from the paper tray support 20 through the nip 42 between rollers 44 and 46. Downstream of the rollers 44 and 46 are slots 194 and 196, which extend through the upper surfaces 200 and 202 of the step portions 89 and 91, respectively, to allow individual sheets of paper to emerge from the paper tray support module 20.

C. Assembly of the Side Panels 60 and 62

The side panel 60 of FIG. 2 is assembled with the side panel 62 of FIG. 3 to produce the assembled paper tray support module 20 of FIG. 1 by inserting the various rotating elements of FIG. 3 (collectively identified by numeral 63) into their respective bearings and retainers in either side panel 62 or side panel 60 and, thereafter, latching the side panels to one another to define a space, designated generally by the numeral 201, therebetween.

As is seen in FIG. 2, the side panel 60 has a front end 209 with a first hollow strut 210 having a pair of openings 212 and 214 through an end surface 216 thereof. The end surface 216 abuts shoulders 218 and 220 adjacent to a pair of prongs 222 and 224 (FIG. 3) mounted on struts 225 and 226 which project from a hollow block 227 extending inwardly from the side panel 62. The prongs 222 and 224 have detents 228 and 230, which are received in the openings 212 and 214 of projection 210 and snap behind shoulder means 232 which serve as keeper elements within the hollow strut 210 (see also FIGS. 6 and 1). As is seen in FIG. 6, the abutment of surface 216 with the shoulders 218 and 220 adjacent to the prongs 222 and 224 provides a spacing means latching them together.

The rear end 240 of the paper tray support module 20 is held in latched spaced relation by a pair of spacer dowels 242 and 244 and a pair of pronged latching elements, designated generally by the numerals 246 and 248, which project from side panel 60 (see FIG. 2). The dowel 242 abuts at its end face 243 with a flat surface 250 on a projection 252 (see FIG. 3) which extends from the step portion 91 of side panel 62, while the latching prongs 246 extend into a recess 254 in the projection 252. A pair of prongs 253 or latching element each have shoulders 256 for engaging behind surfaces 258 which serve as keeper elements within the opening 254 to prevent the side panels 60 and 62 from pulling apart while having flat surfaces 260 which abut the raised end face 262 on the projection 252.

The spacer dowel 244, extending from the step portion 89 of side panel 60 (see FIG. 2), abuts its end face 245 with an end surface 264 on a projection 266 extending from the step portion 90 of side panel 62 (see FIG. 3) while detents 270 extending from the cylindrical latching element 248 are received within circular opening 272. The detents 270 each have shoulders 273 which seat behind an internal rim 274 adjacent circular opening 272 to prevent the side panels 60 and 62 from pulling apart. Adjacent the detents 270 are end surfaces 275 which abut the external perimeter face 276 of the opening 272 so as to stabilize the latching relation- ship of detents within the opening.

Figure 6:
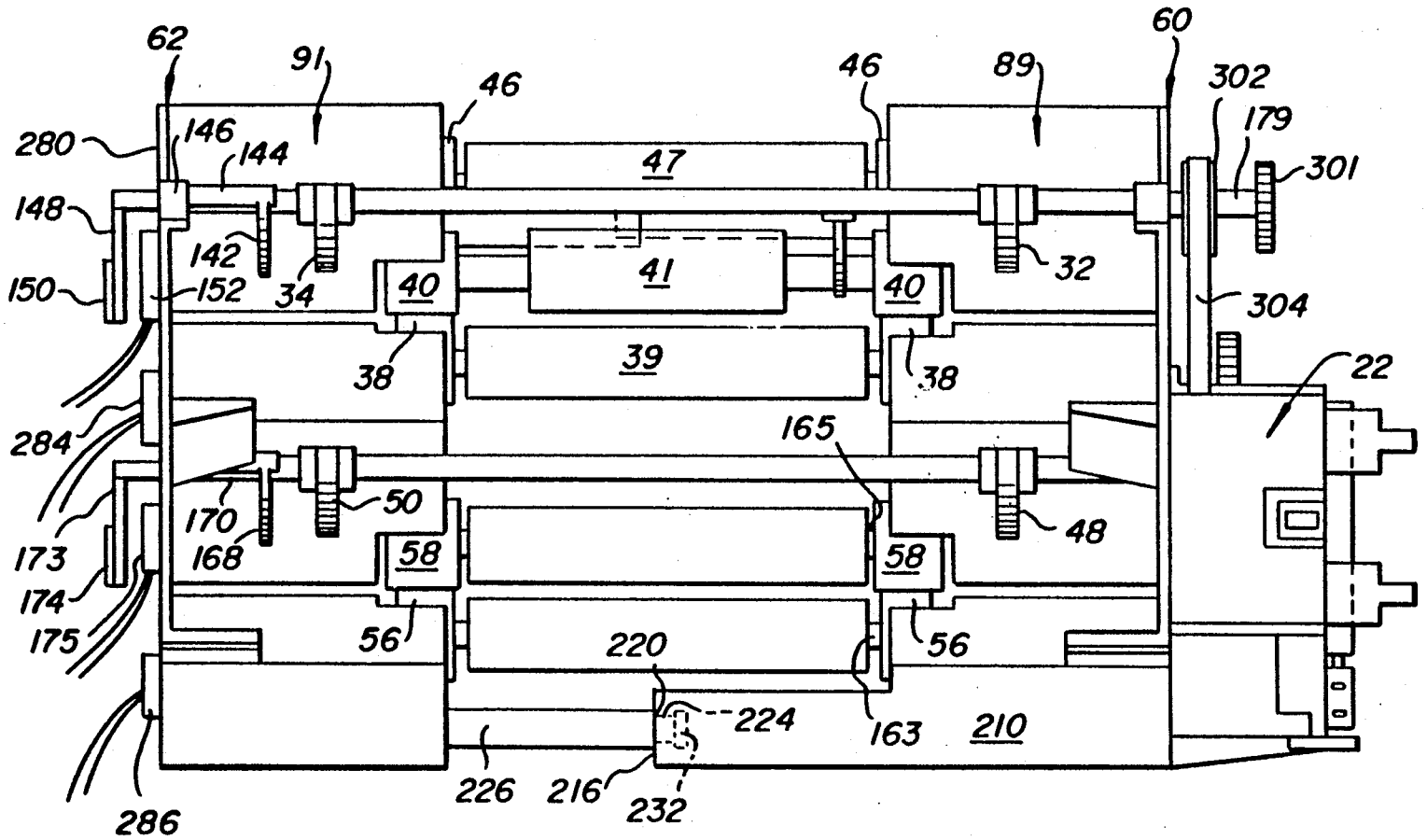
FIG. 6 is a front view of the paper tray support of FIG. 1.
Figure 9:
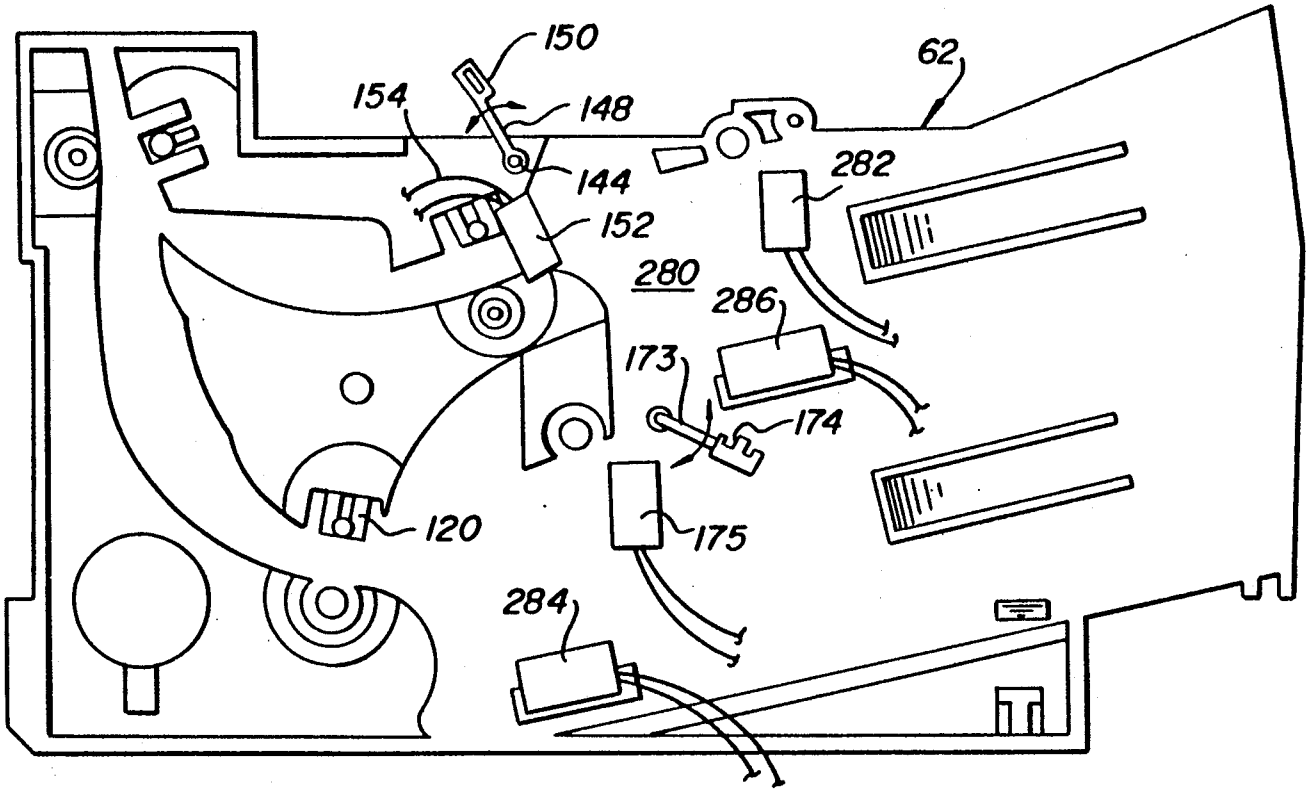
FIG. 9 is a side view of the other side of the paper tray support showing magnetic sensors fixed to the outside surface of a side panel thereof.

As is seen in FIG. 6 and 9, the outside surface 280 of the second side panel 62 has electrical sensors thereon, such as the sensors 152 and 175, for signaling whether the paper tray is full or empty and the sensors 282 and 284, which indicate the presence or absence of the papers trays 26 and 30 (see FIG. 1). Since the side panels 62 is made of a dielectric material, magnetic sensing based on the presence or absence of a magnetic element is easily accomplished. Securing the magnetic sensors 152, 175, 282, and 284 by adhesive, rivets, or the like is easily accomplished since the surface 280 of side pan By utilizing the aforementioned assembly technique, which relies on unitary side panels 60 and 62 having cooperating latches and stops, rapid assembly of the paper tray support module 20 is achieved. The number of separate pieces required for the assembly 20 is minimized with respect to the number of rotating components which ordinarily would require numerous separate bearings, springs, washers, bushings, and the like. If these elements were separate they could easily be installed in the wrong place, oriented in the wrong direction, or perhaps even be left out entirely.

D. The Feed Mechanism 22

Figure 7:
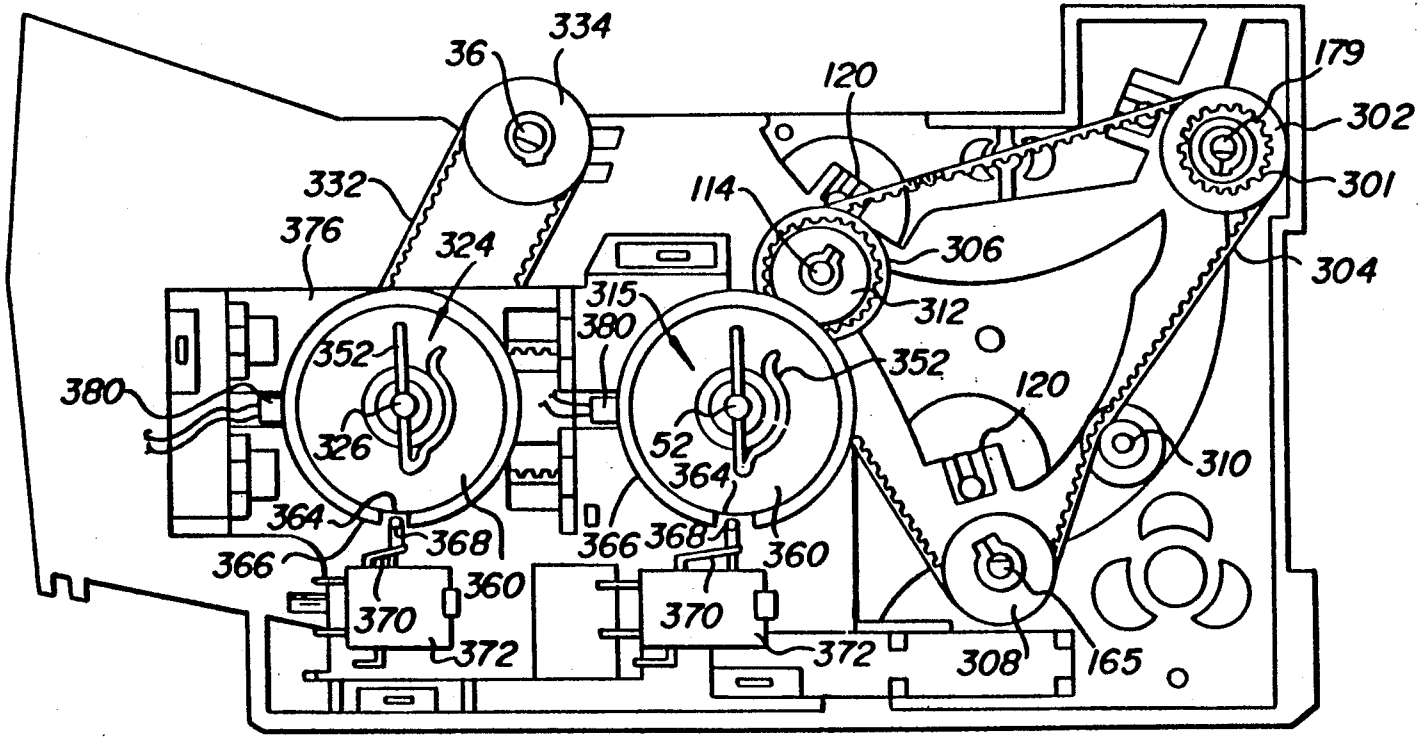
FIG. 7 is a side view of one side of the paper tray support, showing a drive mechanism for the paper feed and including a pair of cam wheels and associated switches.
Figure 8:
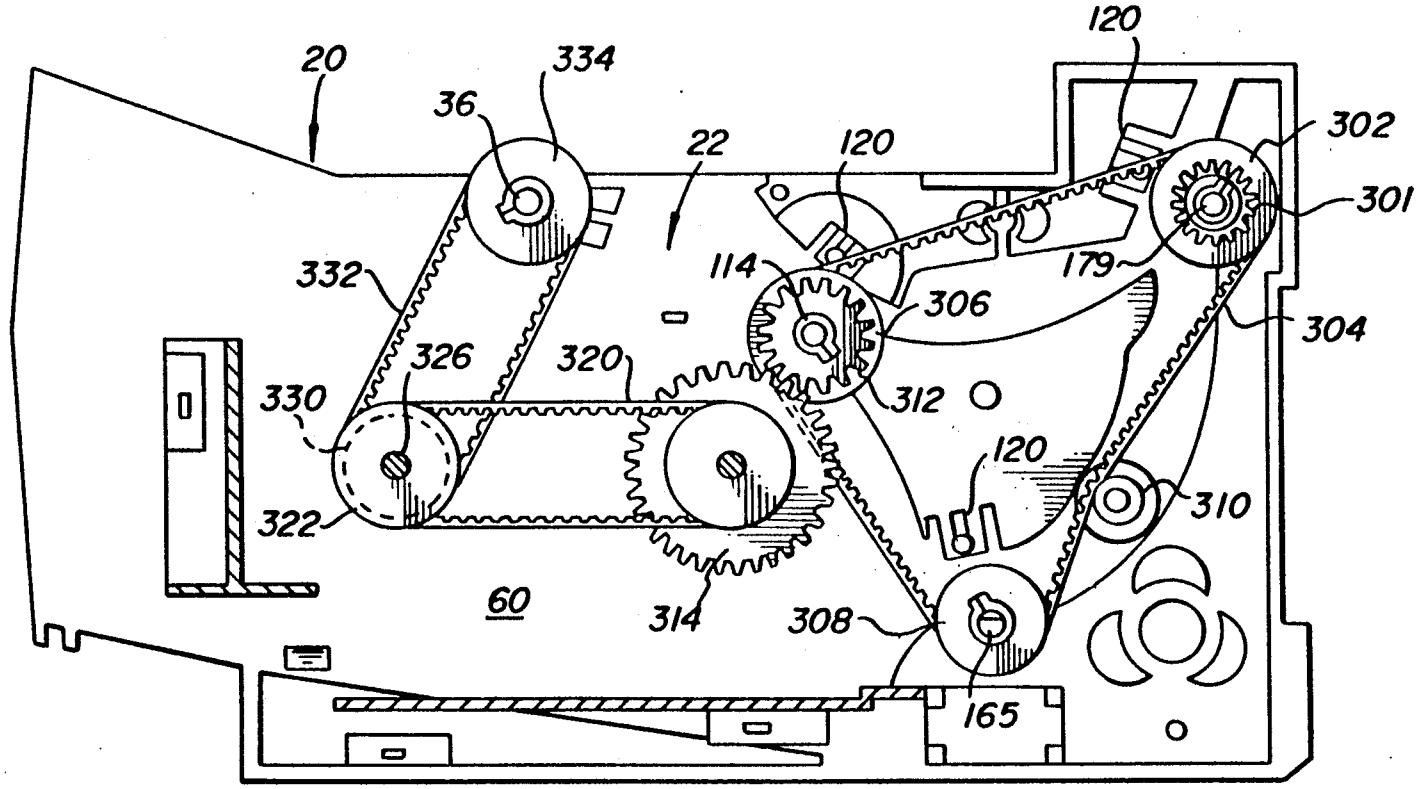
FIG. 8 is a side view similar to FIG. 7 but showing the cam wheels and associated switches removed for clarity.

Referring now mainly to FIG. 10 (in conjunction with FIGS. 7, 8, and 11–13), when the control logic 376 (FIG. 13) of the reproduction apparatus (not shown) requires a sheet of paper from either the stack 24 or the stack 26 (FIG. 1), a drive gear 300 within the reproduction apparatus (not shown) starts rotating a gear 301 fixed to the shaft 179 mounting the final feed rollers 44. Rotation of the shaft 179 rotates the final feed rollers 44, as well as a sprocket 302. As is best seen in FIGS. 7 and 8, a cogged belt 304 is trained around the sprocket 302, around a drive sprocket 306 for the rollers 38 fixed to shaft 114, and around a drive sprocket 308 fixed to drive shaft !65 for the rollers 56. As is seen in FIG. 7, the belt 304 is tensioned by an idler roller 3!0, freely journaled on side panel 60.

Coaxial with shaft 114 and drive sprocket 306 is gear 312, which meshes with gear 314 that is, in turn, coaxial with shaft 52 upon which the lower D-rollers 48 and 50 are fixed to comprise a first feed drive, designated generally by the numeral 315. Fixed to the gear 314 is a sprocket 316, which rotates with the gear 314 normally independent of shaft 52 unless coupled to the shaft 52 by a magnetic clutch, designated generally by the numeral 318.

As will be explained in more detail hereinafter, the magnetic clutch 318 is selectively energized to selectively transfer the rotation imparted by gear 312 via gear 314 to the shaft 52 in order to dispense sheets of paper one at a time from the lower stack 28 in tray 30 (see FIG. 1).

Whether or not the magnetic clutch 318 is energized, rotation is transferred continuously via cog belt 320 to a sprocket 322 in a second feed drive, designated generally by the numeral 324. Normally, the sprocket 322 rotates freely on a shaft 326; however, when a magnetic clutch 328 is energized, sprocket 322 is coupled to the shaft 326 to rotate the shaft 326 therewith. Fixed to the shaft 326 is an output sprocket 330 which is meshed with cogged belt 332 that is, in turn, fixed to D-roller shaft 36. Rotation of the D-roller shaft 36 rotates the D-rollers 32 and 34 to advance sheets of paper one at a time from the stack 24 in upper tray 26 (see FIG. 1). The magnetic clutches 318 and 328 are, for example, available from Inertia Dynamics, Inc. of Collinsville, Conn., and are identified by Model No. WSLI15-38-026 24 VDC.

FIG. 11 illustrates the structure of first feed drive 315, which rotates D-roller shaft 52. FIG. 11 also illustrates the cooperation of the magnetic clutch 318 with input gear 314 and sprocket 316. As stated before, input gear 3!4 and sprocket 316 are positively coupled to one another and normally rotate freely with respect to the D-roller shaft 52. In the illustrated embodiment, coupling is accomplished by pins 336, which extend from the drive gear 314 into the sprocket 316.

The sprocket 316 is coupled via a coil spring 340 to an input hub 342 of the magnetic clutch 318. This is accomplished by having one end 344 of the coil spring fixed to a recess 346 in a collar portion 348 of the hub and the other end 350 of the spring fixed to sprocket 316. Spring 340 provides for a relatively gradual impulse when the magnetic clutch 318 locks the input hub 342 to the shaft 52.

Fixed to the shaft 52 by a cotter pin 352 is an output hub 354, which extends coaxially along the D-roller shaft 52 and terminates beneath the gear 314. A stator coil 356 surrounds the collar 348 of the input hub 342 and, when energized, magnetically locks the input hub 342 to the output hub 354. Since the output hub 354 is fixed to the D-roller shaft 52, torque imparted by rotation of the gear 314 is transmitted through to the D-roller shaft.

Also fixed to the D-roller shaft 52 and to the output hub 354 is a cam wheel 360. Preferably, this is accomplished by the same cotter pin 352, which locks the shaft 52 to the output hub 354. As will be further explained hereinafter with reference to FIG. 13, the cam wheel 360 indexes the rotation of shaft 52 so that the shaft makes only one rotation per instruction from the reproduction apparatus (not shown).

Figure 12:
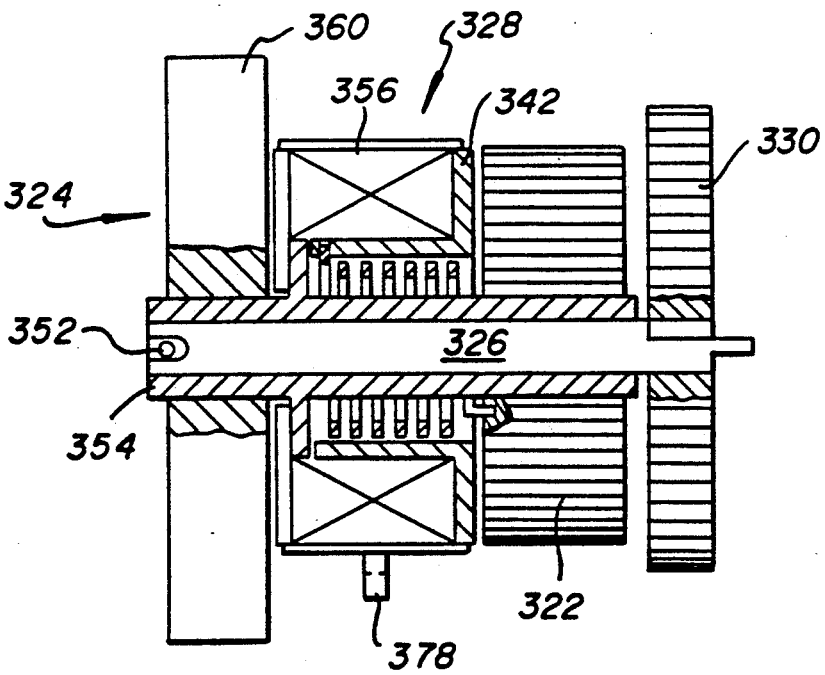
FIG. 12 is a side elevation of a second magnetic clutch mechanism used to rotate D-rollers for displacing single sheets of paper from a stack of paper in a second tray.

Referring now to FIG. 12, where the second feed drive 324 is illustrated, substantially the same structure is relied on to perform substantially the function, and the same reference numerals identify similar structure. The only difference between the first drive 315 and the second drive 324 is that the output hub 354 of the second drive is connected to the intermediate shaft 326, which is coupled to D-roller shaft 36 via the sprocket 330, as was explained with respect to FIGS. 8 and 10. As with the drive 315, the input hub 342, which in FIG. 12 is coupled to sprocket 322, rotates freely on shaft 326 until the coil 356 of the second electromagnet 328 is energized.

Referring now to FIG. 7 in conjunction with FIGS. 10-12, it is seen that the cam wheels 360 each have a single indicator slot 364 in the peripheries 366 thereof. Registered with the slots 364 are cam-following detents 368 for sensing the indicator slots. Cam following detents 368 are in the form of rollers mounted on spring-biased switch arms 370, which operate cam switches 372. The spring arms 370 are normally urged toward the switch-open mode and toward the cam wheels 360. As long as the cam followers 360 are within the slots 364, the switches 372 are open. However, once the cam wheels 360 are rotated so as to cam the cam follower 368 out of the slots 364 onto the peripheries 366 of the wheels, the switches 372 close. The logic and control circuitry (FIG. 13) of the reproduction apparatus (not shown) is operated so that paper is dispensed from either the upper stack 24 or the lower stack 28 (see FIG. 1), but not both simultaneously. Accordingly, only one of the cam wheels 360 rotates during a particular feed cycle.

As is seen in FIG. 7 in conjunction with FIG. 10, cam wheels 360 and cam switches 372 are mounted on the outside of a molded partition 376, which is assembled to the first side panel 60 of the paper tray support module 20. The partition 376 also retains the stator coils 356 of the magnetic clutches 318 and 328, respectively, by engaging with lugs 378 depended from the stator coils (FIGS. 11 and 12) and electrical socket housings 380 integral with the stator coils for providing current to the stator coils.

Figure 13:
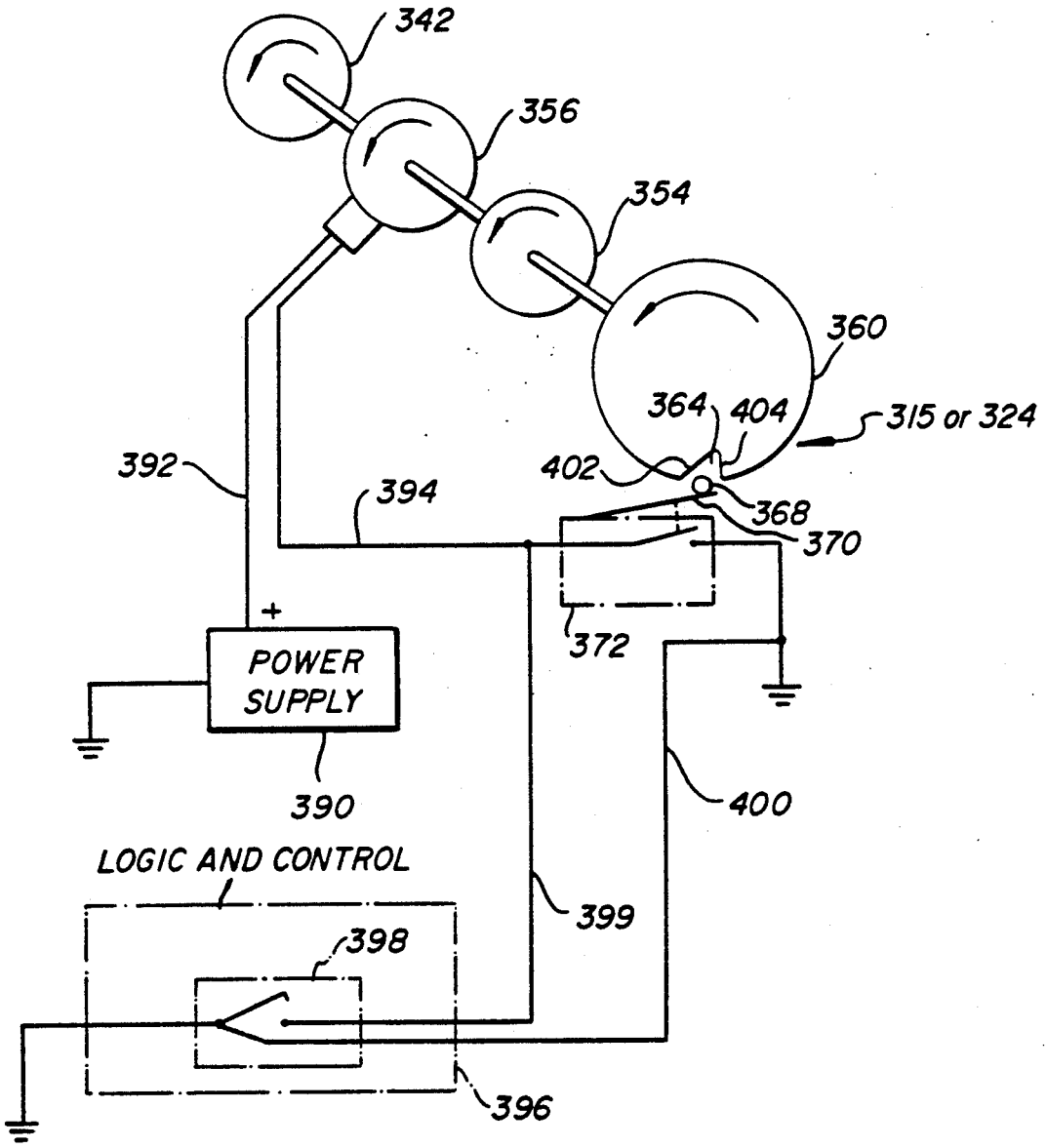
FIG. 13 is a schematic illustrating showing how the magnetic clutch mechanisms of FIGS. 11 and 12 are controlled in accordance with the principles of the instant invention.

Referring now to FIG. 13, a schematic illustration shows how the first and second feed drives 315 and 324 are controlled in accordance with the principles of the instant invention. The stator coil 356 couples the input hub 342 to the output hub 354 and to the cam wheel 360. The stator coil 356 is connected to a power supply 390 via a line 392 and to ground via line 394. The line 394 is connected to cam switch 372, which through spring arm 370 biases the cam follower roller 368 into the indicator slot 364 of the cam wheel 360. A logic and control circuit 396 within the reproduction apparatus (not shown) includes a normally open logic and control switch 398 and line 399 connecting line 394 to ground. When closed, switch 399 serves as an actuator to energize the stator coil 356 coupling both the output hub 354 and the cam wheel 360 fixed thereto to the input hub 342. This causes the cam wheel 360 to rotate in the counterclockwise direction.

Immediately upon starting to rotate, the cam wheel 360 cams the detent 368 out of the slot 364, which closes the cam switch 372. The cam switch 372 is connected back through the logic and control circuit 396 via a line 400 to the logic and control switch 398, which is normally open but has been closed by an instruction from logic and control circuit 396. Upon closing the cam switch 372, the logic and control switch 398 opens. Since current from the power supply 390 is now continually flowing through the stator coil 356 by virtue of cam switch 372 connecting line 394 to ground, the input hub 342 and output hub 354 remain magnetically coupled as long as the cam switch 372 is closed.

Upon the cam following roller 368 dropping back into the slot 364, the cam switch 372 opens, interrupting power to the stator coil 356 and decoupling the output hub 354 and cam wheel 360 from the input hub 342. Since logic and control switch 398 is also open, registration of roller 368 in the slot 364 terminates rotation of the output hub 354 after one rotation, limiting rotation of whichever D-roller shaft 36 or 52 associated with the output hub 354 to a single rotation per instruction from the logic and control circuit 396.

The spring load on the cam follower 368 exerted by the spring arm 370 of the cam switch 372 serves as a brake to hold the cam 360 in a stop position against the internal drag of the clutch components 352 and 354. In order to ensure that the cam wheel 360 can only rotate in a counterclockwise direction, the slot 364 has a gradual ramp 402 on one side and an abrupt, substantially radial surface 404 defining the other side. The abrupt surface 404 jams against the cam follower roller 368 if one attempts to rotate the cam wheel 360 in the counterclockwise direction.

In the instant invention, a paper tray support module 20, utilizing unitary components and combined with a unique paper feed mechanism 22, provides a reliable, relatively inexpensive modular unit for use with reproduction apparatus of the type which are especially useful as desktop copiers.

Without further elaboration, it is believed that one skilled in the art can, using the preceding description, utilize the present invention to its fullest extent.

The entire disclosures of all applications, patents, and publications, cited herein, are hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A modular paper cassette support useful in reproduction apparatus, comprising:

first and second side panels configured of a resinous material for assembly in opposed relation to define a space therebetween, the assembly having a paper cassette support section and a paper transport section, the paper cassette support section having shelf means unitary with the side panels and extending into the space for supporting at least one paper cassette and the paper transport section having stepped portions unitary with the side panels and extending into the space in juxtaposition with the paper cassette section, each step portion having slot means molded therein for passage of paper sheets removed from the paper cassette and having spindle retainers and shaft bearings unitary therewith and molded therein adjacent the slot means.

2. The modular paper cassette support of claim 1, wherein the resinous material comprising the side panels has conductive fibers distributed therein to minimize the accumulation of electrostatic charge on the side panels.

3. The modular paper cassette support of claim 2, wherein the fibers are carbon fibers.

4. The modular paper cassette support of claim 3, wherein the resinous material of which the side panels are comprised includes a self-lubricating material distributed therein.

5. The modular paper cassette support of claim 1, wherein the resinous material includes a distributor of carbon fibers therein for minimizing accumulation of electrostatic charge on the side panels and wherein the resinous material includes a distribution of self-lubricating material therein in a range of 8 to 20 percent by weight to provide self-lubricating shaft bearings.

6. The modular paper cassette support of claim 1, including latching means molded in unitary relation with the side panels for retaining the side panels in assembled relation one with the other.

7. The modular paper cassette support of claim 6, wherein the latching means comprises a plurality of latching elements projecting in spaced relation from the side panels across the space to latch with complementary keeper elements also extending from the side panels.

8. The modular paper cassette support of claim 7, further including stop members molded unitarily with the side panels and projecting therefrom to abut stop members aligned therewith and projecting from the other side panel.

9. The modular paper cassette support of claim 8, wherein each stop member is disposed adjacent a latching element.

10. A modular paper cassette support useful ., in reproduction apparatus, comprising:

first and second side panels configured of a resinous material for assembly in opposed relation to define a space therebetween, the assembly having a paper cassette support section and a paper transport section, the paper cassette support section having shelf means unitary with the side panels and extending into the space for supporting at least one paper cassette and the paper transport section having stepped portions unitary with the side panels and extending into the space in juxtaposition with the paper cassette section, each step portion having slot means molded therein for passage of paper sheets removed from the paper cassette and having spindle retainers and shaft bearings unitary therewith and molded therein adjacent the slot means;

an array of rollers paired in opposed relation;

spindles supported by the spindle retainers to extend between the stepped portions of the side panels and shafts journaled in the shaft bearings to extend between the side panels, the spindles and shafts mounting the array of rollers for engaging sheets of paper in the slot means;

a drive mechanism integral with one of the side panels; and means coupling the drive mechanism to each of the shafts for rotating the shafts to rotate the rollers for one revolution to advance the sheets of paper through the slots and out of the modular paper cassette support for processing by the reproduction apparatus.

11. The modular paper cassette support of claim 10, further including a sensing arm disposed in the space and journaled in a bearing unitary with a side panel, the sensing arm having a magnet attached thereto which is movable with the sensing arm to pivot into juxtaposition with a magnetic sensor mounted on the side panel to indicate the amount of paper in the cassette.

12. The modular paper cassette support of claim 10, further including shaft bearings molded in and unitary with the side panels adjacent the paper cassette supporting section and at least one shaft for supporting D-rollers to advance single sheets of paper from a paper stack mounted in the shaft bearings, the shaft being positively coupled to the drive mechanism.

13. The modular paper cassette support of claim 12, wherein there are at least two shafts for supporting D-rollers, the shafts being each disposed adjacent separate cassettes in shaft bearing molded in and unitary with the side panels.

14. A drive mechanism comprising:

a magnetic clutch having a stator coil, an input hub, and an output hub;

an output shaft having the input hub mounted for free rotation thereon and the output hub mechanically connected thereto for rotation therewith, wherein when the stator coil is energized, the input hub magnetically couples the output hub and input hub;

means for continuously rotating the input hub;

indicator means mounted on the output shaft for indicating one revolution of the output shaft;

sensing means aligning with the indicator means at the start and completion of one revolution of the output shaft;

a power supply;

means for electrically connecting the power supply to the coil of the magnetic clutch, said electrical connecting means including a control switch for energizing the magnetic clutch when closed to thereby rotate the output shaft and indicator means, said electrical connecting means further including a sensing switch activated by the sensing means and means for holding the sensing switch open when the sensing means aligns with the indicator means on the output shaft and for holding the sensing switch closed when the sensing means does not align with the indicator means, the sensing switch being connected to the control switch; and means operated by the sensing switch and associated with the control switch for opening the control switch when the sensing switch is closed, whereby the output shaft performs one rotation for each closing of the control switch.

15. The drive mechanism of claim 14, wherein the indicator means is a cam wheel with a single slot in the periphery thereof and wherein the sensing means is a cam follower which allows the sensing switch to remain open when the cam follower is in alignment with the slot and closes the sensing switch when out of alignment with the slot and in engagement with the periphery of the cam wheel.

16. A drive mechanism, useful for rotating paper feed rollers one revolution at a time, comprising:

a magnetic clutch having a stator coil, an input hub, and an output hub;

an output shaft having the input hub mounted for free rotation thereon and the output hub mechanically connected thereto for rotation therewith, wherein when the stator coil is energized, the input hub magnetically couples the output hub and input hub;

means for continuously rotating the input hub;

a cam mounted on the output shaft to rotate therewith, the cam having an indicator at one location thereon for indicating one revolution of the cam;

a cam follower for sensing the presence of the indicator at one location to detect the occurrence of one revolution of the cam;

a power supply;

means for electrically connecting the power supply to the coil of the magnetic clutch, said electrical connecting means including a control switch for energizing the electromagnet when closed to thereby rotate the output shaft and cam, said electrical connecting means further including a cam switch activated by the cam follower and means for holding a cam switch activated by the cam follower and means for holding the cam switch open when the follower detects the indicator on the cam and for holding the cam switch closed when the follower does not detect the indicator, the cam switch being connected to the control switch; and means operated by the cam switch and associated with the control for opening the control switch when the cam switch is closed, whereby the output shaft performs one rotation for each closing of the control switch.

17. The drive mechanism of claim !6, wherein the cam is a wheel with a single slot in the periphery thereof and wherein the cam follower allows the cam switch to remain open when the cam follower is in the slot and closes the cam switch when out of the slot and in engagement with the periphery of the cam wheel.

18. A paper feed drive mechanism for rotating a paper feed roller which feeds single sheets of paper to a reproduction apparatus which includes logic and control circuitry, the paper feed mechanism comprising:

a magnetic clutch having an input hub and an output hub;

an output shaft having the output hub mechanically connected thereto and the input hub mounted thereon for free rotation with respect thereto, the output shaft being connected to the feed roller for rotating the feed roller;

means for rotating the input hub continuously;

a cam fixed to the output shaft, the cam having an indicator thereon for indicating one revolution of the cam, output shaft, and feed roller;

a power supply;

means for electrically connecting the power supply to the magnetic clutch, said electrical connecting means including a logic and control switch closed by the logic and control circuitry of the associated photocopying machine for energizing the electromagnet to thereby rotate the output shaft, cam and feed roller, said electrical connecting means further including a cam switch activated by the cam and means for holding the cam switch open when registered with the indicator on the cam and for holding the cam switch closed when not registered with the indicator, the cam switch being connected to the logic and control switch; and means operated by the cam switch and associated with the logic and control switch for opening the logic and control switch when the cam switch is closed, whereby the feed roller performs one rotation for each closing of the logic and control switch.

19. The paper feed drive mechanism of claim 18, wherein the input hub is a first gear and wherein the means for rotating the input hub continuously is a second gear meshed with the first gear, the second gear being driven by a continuous drive system located downstream of the paper feed drive mechanism.

20. The paper feed drive mechanism of claim 19, wherein the input hub is a first sprocket and wherein the means for rotating the input hub continuously is a cogged belt trained around a second sprocket, the second sprocket being drive by a continuous drive system located downstream of the paper feed drive mechanism.

21. A paper feed drive mechanism integral with a paper cassette support module supporting at least two paper cassettes, the mechanism feeding single sheets of paper from stacks in the cassettes to a reproduction apparatus controlled by logic and control circuitry, comprising:

at least first and second output shafts journaled in the paper cassette support module, each in proximity with one cassette and having feed rollers mounted thereon;

first and second feed drives for driving the first and second output shafts, respectively, each feed drive being coaxial about a shaft positively associated with one of the output shafts;

first and second magnetic clutches included within the first and second feed drives, respectively;

first and second input hubs within the first and second magnetic clutches, each normally freely rotatable on the shafts with which the first and second feed drives are coaxial;

means for coupling the first and second input hubs to one another for rotation together;

means for continuously rotating the first and second input hubs when the photocopy machine is in a copying mode;

first and second output hubs mechanically coupled to the shaft within the first and second feed drives;

first and second stator coils associated with the first and second magnetic hubs, respectively, for coupling the hubs to the shafts within power supply means for energizing the first , and second stator coils separately to couple the associated input and output hubs and thereby rotate the first or second output shafts and associated feed rollers selectively and individually;

first and second cams fixed to the shaft of each feed drive, each cam having an indicator at one location thereof for indicating one revolution of the cam and thus one revolution of the associated feed roller;

first and second cam switches having means thereon for sensing a single rotational position of the indicators on the first and second cams, respectively, the switches being in open modes when sensing the single rotational positions and closed modes when not sensing the single rotational positions;

logic switching means connected to the power supply means for selectively activating the power supply means when closed to energize the magnetic clutches alternatively, the logic switching means being connected to the cam switches and having means for opening upon closing the cam switches, whereby the shafts within the feed drives rotate the output shafts and feed rollers one revolution to feed one sheet of paper for each closing of the logic switching means.

* * * * *

UNITED STATES PATENT AND TRADEMARK OFFICE

CERTIFICATE OF CORRECTION

PATENT NO. : 5,069,438

DATED : December 3, 1991

INVENTOR(S) : Carl T. Urban, et al

It is certified that error appears in the above-identified patent and that said Letters Patent is hereby corrected as shown below:

On the Title page, In the Abstract:
line 19, after "This" insert --is--.

Col. 11, line 47 after "useful" delete --,--.

Col. 13, line 39 change "!6" to --16--.

Col. 14, line 54 after "within" add --the first and second feed means;--.

Signed and Sealed this

Sixth Day of April, 1993

*Attest:*

*Attesting Officer*

STEPHEN G. KUNIN

*Acting Commissioner of Patents and Trademarks*